US005557920A

United States Patent [19]

Kain

[11] Patent Number: 5,557,920

[45] Date of Patent: Sep. 24, 1996

[54] COMBUSTOR BYPASS SYSTEM FOR A GAS TURBINE

[75] Inventor: Jeffrey A. Kain, Chuluota, Fla.

[73] Assignee: Westinghouse Electric Corporation, Pittsburgh, Pa.

[21] Appl. No.: 414,144

[22] Filed: Mar. 30, 1995

Related U.S. Application Data

[63] Continuation of Ser. No. 168,489, Dec. 22, 1993, abandoned.

[51] Int. Cl.[6] ..... F02C 9/18

[52] U.S. Cl. ..... 60/39.23; 60/39.32

[58] Field of Search ..... 60/39.23, 39.29, 60/39.31, 39.32, 752

[56] References Cited

U.S. PATENT DOCUMENTS

| | | | |
|---|---|---|---|
| 3,859,786 | 1/1975 | Azelborn et al. | 60/39.23 |
| 3,919,838 | 11/1975 | Armstrong et al. | 60/39.23 |
| 3,930,368 | 1/1976 | Anderson et al. | 60/39.23 |
| 3,958,413 | 5/1976 | Cornelius et al. | 60/39.23 |

FOREIGN PATENT DOCUMENTS

| | | |
|---|---|---|
| 3942451 | 6/1991 | Germany . |
| 4034711 | 2/1992 | Germany . |
| 2086031 | 5/1982 | United Kingdom . |

*Primary Examiner*—Louis J. Casaregola
*Attorney, Agent, or Firm*—M. G. Panian

[57] ABSTRACT

An apparatus for causing a portion of the compressed air from the compressor section of a gas turbine to bypass the combustor. The apparatus comprises a clamping ring and a rotating ring. The clamping ring joins the aft end of the combustor to the front end of a duct that directs the hot gas from the combustor to the turbine section. The rotating ring encircles the clamping ring. When the rotating ring is rotated into a first position, ports disposed in the rotating ring are aligned with ports in the clamping ring so that air can flow into the hot gas flowing between the combustor and the duct. However, the ports in the rotating ring are completely blocked by the clamping ring when the rotating ring is rotated into a second position and partially blocked when the rotating ring is rotated into intermediate positions. An actuating ring that encircles the combustion chamber controls the rotation of the rotating ring by means of an actuating rod that extends into the shell.

14 Claims, 4 Drawing Sheets

COMBUSTOR BYPASS SYSTEM FOR A GAS TURBINE

This application is a continuation of application Ser. No. 08/168,489 filed Dec. 22, 1993 (abandoned).

BACKGROUND OF THE INVENTION

The present invention relates to an apparatus for causing a portion of the compressed air from the compressor section to bypass a combustor in a gas turbine so that the bypassed air enters the hot gas flow path downstream of the combustor but upstream of the turbine.

A gas turbine is comprised of a compressor section that produces compressed air that is subsequently heated by burning fuel in a combustion section. The hot gas from the combustion section is directed to a turbine section where the hot gas is used to drive a rotor shaft to produce power. The combustion section is typically comprised of a shell that forms a chamber that receives compressed air from the compressor section. A plurality of cylindrical combustors are disposed in the chamber and receive the compressed air along with the fuel to be burned. A duct is connected to the aft end of each combustor and serves to direct the hot gas from the combustor to the turbine section.

In the past, a cylindrical collar, sometimes referred to as a "clam shell," was used to join the aft end of the combustor to the forward end of the duct. The collar was longitudinally split into two halves and joined along flanges. The collar encircled the aft end of the combustor and the forward end of the duct so as to join the two components together.

In order to control the formation of oxides of nitrogen ("NOx"), considered an atmospheric pollutant, during the combustion process, it is sometimes desirable to cause a portion of the compressed air from the compressor section to bypass the combustors, especially during part-load operation. In the past, this has been accomplished by installing a butterfly type valve directly into the duct that directs the hot gas to the turbine so that a portion of the compressed air from the chamber bypasses the combustor and enters the hot gas flowing through the duct.

Unfortunately, this approach suffers from a variety of drawbacks. The duct must frequently be replaced because of the effects of thermal stress and corrosion. Hence, the incorporation of the butterfly valve directly into the duct increases the cost of maintaining the gas turbine. Second, introducing air directly into the duct at one localized spot can create distortions in the temperature profile of the hot gas flowing into the turbine section. Third, the butter fly valves are subject to leakage, resulting in a loss in thermodynamic performance when the bypassing of air is not desired.

It is therefore desirable to provide an apparatus for causing a portion of the compressed air from the compressor section to bypass the combustor and enter the hot gas flow path downstream of the combustor that will be durable, prevent distortions in the gas temperature profile, and prevent unwanted leakage of air into the hot gas flow path.

SUMMARY OF THE INVENTION

Accordingly, it is the general object of the current invention to provide an apparatus for causing a portion of the compressed air from the compressor section to bypass the combustor and enter the hot gas flow path downstream of the combustor that will be durable, prevent distortions in the gas temperature profile, and prevent unwanted leakage of air into the hot gas flow path.

Briefly, this object, as well as other objects of the current invention, is accomplished in a gas turbine comprising (i) a compressor for producing compressed air, (ii) a combustion zone in which a fuel is burned in a first portion of the compressed air, thereby producing a hot gas, (iii) a turbine for expanding the hot gas, (iv) a flow path for directing the hot gas produced in the combustion zone to the turbine, and (v) means for causing a second portion of the compressed air to bypass the combustion zone and enter the flow path downstream of the combustion zone. The flow path comprises a cylindrical liner enclosing the combustion zone and a duct disposed between the liner and the turbine. The bypass means includes a collar encircling a portion of the flow path and extending between the liner and the duct. The collar includes a ported clamping ring and a ported rotating ring encircling the clamping ring. The bypassing of air is regulated by rotation of the rotating ring.

DESCRIPTION OF THE PREFERRED EMBODIMENT

Figure 1:
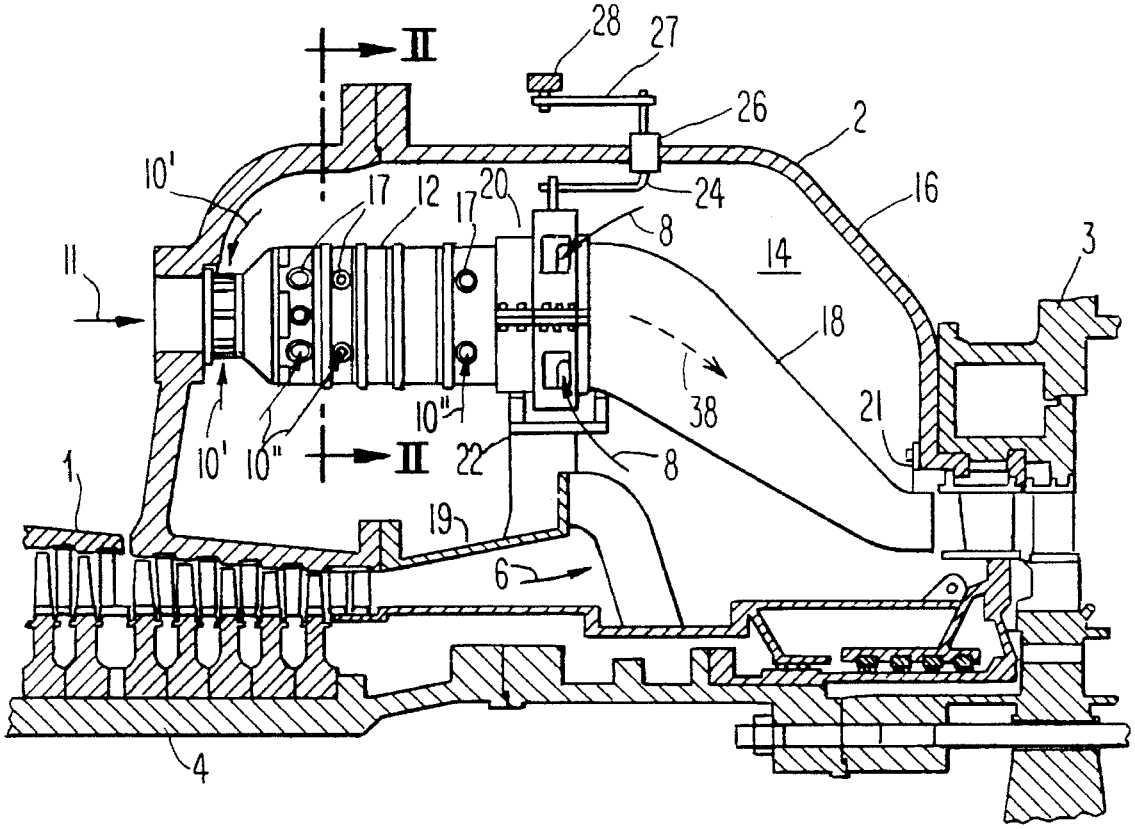
FIG. 1 is a longitudinal cross-section through a portion of a gas turbine incorporating the bypass system of the current invention.

Referring to the drawings, there is shown in FIG. 1 a portion of a longitudinal cross-section of a gas turbine. The gas turbine is comprised of a compressor section 1, a combustor section 2 and a turbine section 3. A rotating shaft 4 extends through the compressor, combustion and turbine sections. As is conventional, the compressor 1 is comprised of alternating rows of rotating blades and stationary vanes that compress ambient air to produce compressed air 6. As is also conventional, the combustion section 2 is comprised of a plurality of combustors 12, each of which is formed by a cylindrical liner. The combustors 12 are circumferentially arranged around the rotor 4 within a chamber 14 formed by a shell 16, as shown best in FIG. 2. The front end of each combustor 12 is secured to the shell 16 via screws (not shown). The aft end of each combustor 12 is supported by a collar assembly 20, discussed further below. (As used herein the term "front" refers to axially upstream and the term "aft" refers to axially downstream.)

A portion 10' of the compressed air 6 enters each of the combustors 12 at its front end along with a supply of fuel 11, which is preferably oil or natural gas. The fuel 11 is introduced into a combustion zone 13, shown in FIG. 2 and enclosed by the combustor 12, via a fuel nozzle (not shown). In the combustion zone 13 the fuel 11 is burned in the compressed air 10' to produce heat. Additional air 10" enters the combustors 12 through holes 17 formed therein and mixes with the air 10' that has been heated by the burning of the fuel 11 to produce a flow of hot gas 38. The hot gas 38 is directed to the turbine section 3, where the hot gas is expanded, by a duct 18, sometimes referred to as a "transition duct." Thus, the combustor 12 and the duct 18 form a portion of the flow path for the hot gas 38. The aft end of each duct 18 is attached to the shell 16 by a bracket 21. The front end of each duct 18 is supported by a support bracket 22 attached to the compressor diffuser 19.

Figure 3:
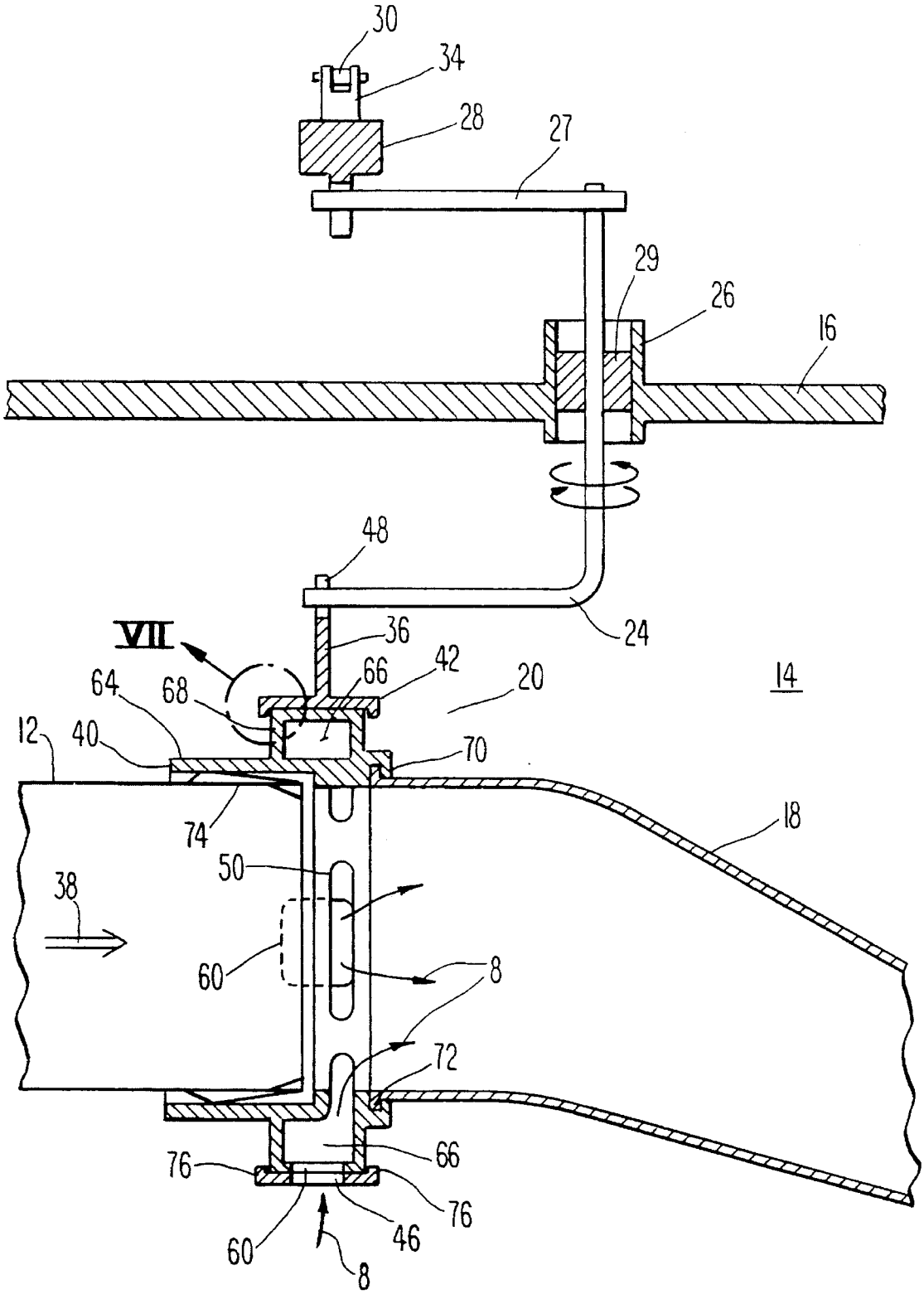
FIG. 3 is a longitudinal cross-section taken through line III—III shown in FIG. 2.

As is conventional, a portion of the compressed air 6 from the compressor 1 is drawn from the chamber 14 by piping (not shown) that discharges it directly into various components of the turbine section 3 for cooling purposes, thereby bypassing the combustors 12. However, according to the current invention, another portion 8 of the compressed air 6 from the compressor 1 is caused to bypass the combustors 12, and therefore the combustion zones 13, by directing it into the hot gas flow 38 at a location between the aft end of the combustors 12 and the front ends of the ducts 18, as shown in FIG. 1. This is accomplished by means of collar assemblies 20, discussed further below. As shown in FIGS. 1 and 3, each collar assembly 20 joins the aft end of a combustor 12 to the front end of a duct 18. The collar assembly 20 is attached to the support bracket 22 that extends from the compressor diffuser 19.

Figure 4:
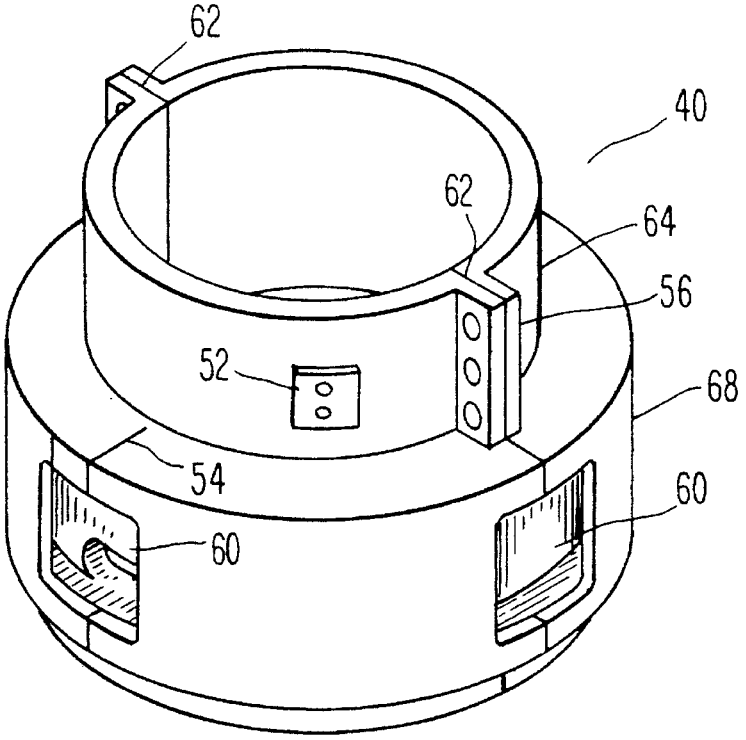
FIG. 4 is an isometric view of the clamping ring portion of the collar assembly shown in FIGS. 1–3, looking into the upstream end.
Figure 5:
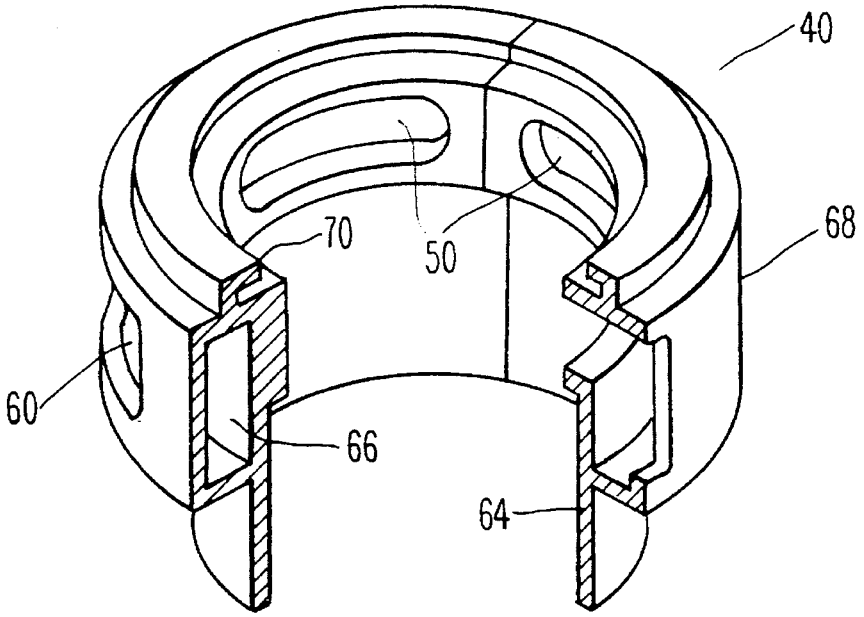
FIG. 5 is an isometric view, partially cut-away, of the clamping ring shown in FIG. 4, looking into the downstream end.

As shown in FIG. 3, the collar assembly 20 is comprised of a clamping ring 40 and a rotating ring 42. As shown in FIGS. 4 and 5, the clamping ring 40 is comprised of an inner sleeve 64 and an outer sleeve 68 that encircles the inner sleeve. Both the inner and outer sleeves 64 and 68, respectively, are split along a longitudinal joint 62 so as to form upper and lower halves. Mating flanges 56 are formed at the joints 62 of the inner sleeve 64.

As shown in FIG. 3, at assembly, the two halves of the clamping ring 40 are slipped around the aft end of the combustor 12 and the front end of the duct 18. The halves are then bolted together using bolts 58, shown in FIG. 1, which extend through the flanges 56, so as to join and support the combustor 12 and the duct 18. A baffle 74 formed at the aft end of the combustor 12 is spring loaded to bear against the inner surface of the inner sleeve 64, thereby forming a seal that prevents the unwanted ingress of compressed air 6 from the chamber 14 into the hot gas 38 flow path. A lip 70 formed at the aft end of the inner sleeve 64 of the clamping ring 40 mates with a flange 72 formed at the inlet of the duct 18.

The inner and outer sleeves 64 and 68, respectively, form a manifold 66 between themselves. Outlet ports 50, in the shape of circumferentially extending slots, are distributed around the inner sleeve 64. Inlet ports 60, having an approximately square shape, are distributed around the outer sleeve 60. Radially extending expansion slots 54 are formed in the outer sleeve 68 side wall to minimize thermal stresses. A support pad 52 formed on the outer surface of the inner sleeve 64 allows the clamping ring 40 to be attached to the support bracket 22, shown in FIG. 1.

Figure 6:
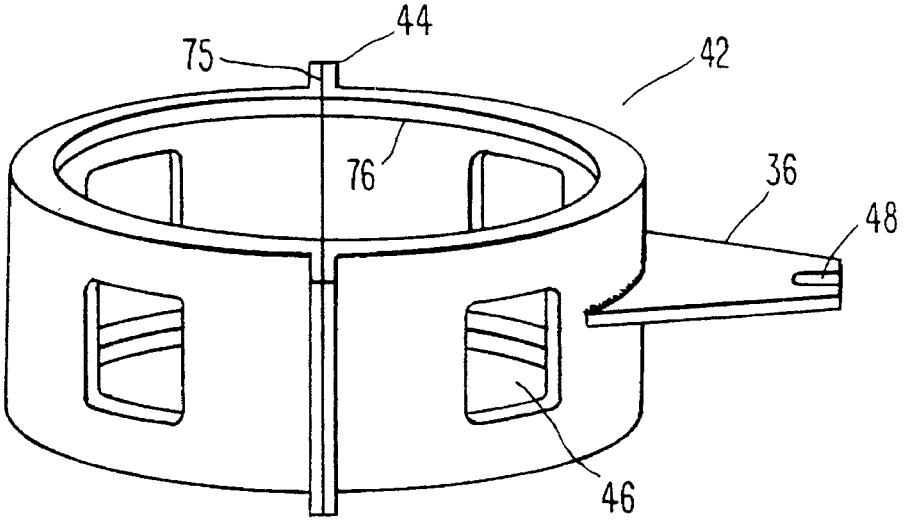
FIG. 6 is an isometric view of the rotating ring portion of the collar assembly shown in FIGS. 1–3.

As shown in FIGS. 3 and 6, the rotating ring 42 is split into upper and lower halves along a longitudinal joint 75, like the clamping ring 40. Mating flanges 44 are formed on the upper and lower halves at the joints 75. At assembly, the two halves of the rotating ring 40 are slipped around the clamping ring 40 so that the rotating ring encircles the outer sleeve 68 of the clamping ring, as shown in FIG. 3. The two halves of the rotating ring 42 are then bolted together using bolts 58, shown in FIG. 1, which extend through the flanges 44.

The inside diameter of the rotating ring 42 is larger that the outside diameter of the outer sleeve 68 so that when fully assembled the rotating ring remains free to slide on the outer sleeve. Lips 76 formed on each end of the rotating ring 42 prevent axial motion of the rotating ring but allow it to slide by rotating circumferentially around the outer sleeve. Approximately square shaped ports 46, having the same size and shape as the inlet ports 60 in the clamping ring outer sleeve 68, are distributed around the circumference of the rotating ring 42.

A lug 36 extends radially from the rotating ring 42. The lug has a slot 48 formed in its distal end. As shown in FIG. 3, an L-shaped actuating rod 24 slides within the slot 48 so that rotation of the actuating rod around its radial axis causes the rotating ring 42 to rotate around the outer sleeve 68 of the clamping ring 40. When the rotating ring 42 is rotated into a first position, shown in FIG. 3, the ports 46 in the rotating ring 42 are radially aligned with the inlet ports 60 in the clamping ring outer sleeve 68. This allows the portion 8 of the compressed air to flow from the chamber 14 into the manifold 66. From the manifold 66 the air 8 flows through the outlet ports 50 of the inner sleeve 64 and into the hot gas 38 flowing into the duct 18.

Note that by using the square shaped inlet ports 46 and 60 to feed the manifold 66 and the slot shaped outlet ports 50, a large flow area is created with a relatively short axial length gap between the combustor 12 and the duct 18, thereby minimizing the length of the combustion section and allowing the collar assembly 20 to be retrofitted onto existing gas turbines. Also, the relatively long circumferential length of the slots 50 allows the air from the manifold 66 to be well distributed circumferentially around the hot gas path, thereby minimizing distortions in the temperature profile of the hot gas 38 entering the turbine section 3.

Figure 7:
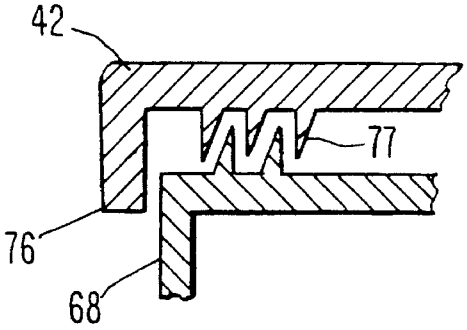
FIG. 7 is a detailed view of the portion of the rotating ring and clamping ring interface enclosed by the circle marked VII shown in FIG. 3.

When the rotating ring 42 is rotated into a second position, its ports 46 are not radially aligned with the clamping ring ports 60 so that the outer sleeve 68 blocks the ports 46 and prevents air from entering the hot gas flow path via the collar assembly 20. Labyrinth type seals 77, shown in FIG. 7, may be formed between the rotating ring 42 and the outer sleeve 68 to minimize any unwanted leakage of air through collar assembly 20 when the rotating ring is in the shut-off position. When the rotating ring 42 is rotated into an intermediate position, the clamping ring outer sleeve 68 will partially block the rotating ring ports 46 so that the flow rate of the compressed air 8 that bypasses the combustor 12 can be regulated.

Figure 2:
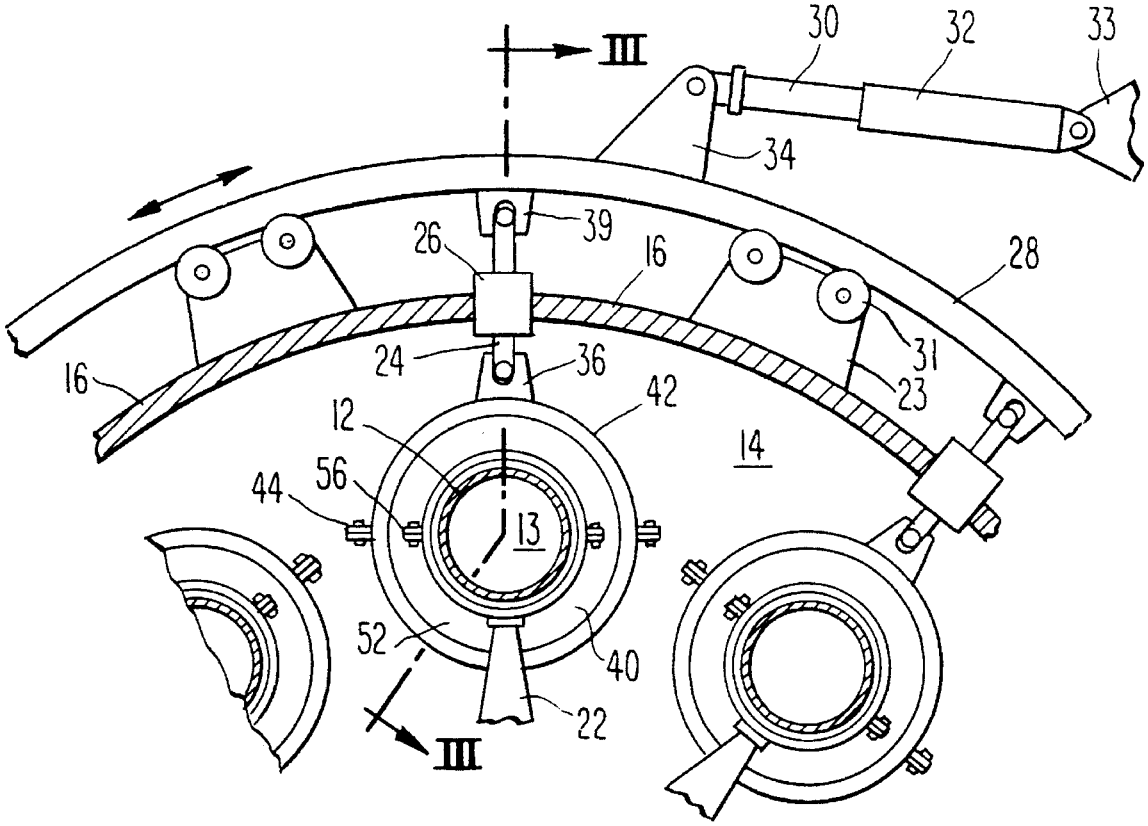
FIG. 2 is a transverse cross-section taken through line II—II shown in FIG. 1, except that the radially extending flange formed on the shell 16 has been omitted to allow viewing of the actuating ring 28 and associated components.

As shown in FIGS. 2 and 3, the actuating rod 24 extends through the shell 16 by means of a sleeve 26. A bearing and seal assembly 29 disposed in the sleeve 26 encases the actuating rod 24 and prevents compressed air from leaking out through the sleeve. A connecting rod 27 connects the actuating rod 26 to an actuating ring 28 that encircles the shell 16. Specifically, one end of the connecting rod 27 is attached to the actuating rod 26 and the other end is attached to a slotted lug 39 that extends from the actuating ring 28. As shown in FIG. 2, the actuating ring 28 is rotatably mounted on rollers 31 attached to supports 23 extending from the shell 16. A piston 30 at one end of a hydraulic cylinder 32 is attached to the actuating ring 28 by means of a bracket 34. The other end of the hydraulic cylinder 32 is attached to a stationary member (not shown) by means of a bracket 33.

Supplying hydraulic fluid (not shown) to the hydraulic cylinder 32 will cause the piston 30 to extend, thereby causing the actuating ring 28 to rotate about the shell 16 in the counter clockwise direction (when viewed in the direction of the flow of the hot gas 38). This will cause the actuating rod 24 to rotate clockwise (when viewed radially inward), which will, in turn, cause the rotating ring 42 to rotate counter clockwise (when viewed in the direction of flow) around the clamping ring 40. A second but oppositely pointing hydraulic cyliner (not shown) can be used to effect clockwise rotation of the actuating ring 28. Alternatively the actuating ring 28 can be spring loaded to oppose the hydraulic piston 30. In any case, according to the current invention, the amount of compressed air 8 bypassing the combustors 12 can be continuously regulated, as necessary to achieve minimum NOx production, as the operating conditions of the gas turbine vary by controlling the postion of the actuating ring 28.

Note that as a result of its size, location and construction, the collar assembly 20 is much less subject to deterioration than the duct 18. Thus, the additional cost associated with imparting the bypass feature to the collar assembly does not result in an increase in the recurring costs associated with maintaining the gas turbine.

The present invention may be embodied in other specific forms without departing from the spirit or essential attributes thereof and, accordingly, reference should be made to the appended claims, rather than to the foregoing specification, as indicating the scope of the invention.

I claim:

1. A gas turbine, comprising:

a compressor for producing compressed air;

a combustion zone in which a fuel is burned in a first portion of said compressed air, thereby producing a hot gas;

a turbine for expanding said hot gas;

a flow path for directing said hot gas produced in said combustion zone to said turbine comprising a liner enclosing said combustion zone and a duct disposed between said liner and said turbine, said liner and said duct each having an upstream and a downstream end; and a collar, encircling said downstream end of said liner and said upstream end of said duct, including a first ring having a first port and a sliding ring encircling said first ring, said first ring and said sliding ring cooperable for causing a second portion of said compressed air to bypass said combustion zone and enter said flow path downstream of said combustion zone through said first port.

2. The gas turbine according to claim 1, wherein said first ring has a plurality of first ports disposed there-around, and wherein said sliding ring has a plurality of second ports disposed there-around.

3. The gas turbine according to claim 2, wherein said first ring forms a manifold and has a plurality of third ports disposed there-around, said third ports forming inlets for said manifold and said first ports forming outlets for said manifold.

4. The gas turbine according to claim 2, further comprising means for sliding said sliding ring into first and second positions, said second ports and said first first ports being aligned when said sliding ring is in said first position, said first ring blocking said second ports when said sliding ring is in said second position.

5. The gas turbine according to claim 4, wherein said means for sliding comprises means for rotating said sliding ring around said first ring.

6. The gas turbine according to claim 1, further comprising means for controlling said bypassing of said second portion of said compressed air by rotating said sliding ring around said first ring.

7. The gas turbine according to claim 6, further comprising a shell forming a chamber in which said flow path is disposed, and wherein said controlling means comprises a rotating member extending through said shell and connected to said sliding ring.

8. A combustion turbine, comprising:

a compressor for producing compressed air;

a combustion zone in which a fuel is burned in a first portion of said compressed air to produce a hot gas;

a turbine, linked to said combustion zone via a flow system having a first port, for expanding said hot gas;

a first collar, associated with said flow system, having a second port in flow communication with said compressor, said first collar being movable between a first position wherein said second port is placed in flow communication with said first port and a second position wherein there is no flow communication between said second port and said first port for allowing a second portion of said compressed air to bypass said combustion zone and enter said flow system downstream of said combustion zone;

wherein said flow system comprises a liner enclosing said combustion zone, a duct leading to said turbine, and a second collar connecting said duct to said liner, said second collar having said first port;

wherein said second collar forms a manifold and has a third port forming an inlet for said manifold and said first port forms an outlet for said manifold.

9. The combustion turbine as recited in claim 8, wherein said first collar encircles said second collar and said first collar is rotatable between said first position and said second position.

10. The combustion turbine as recited in claim 9, further comprising means for rotating said first collar.

11. The combustion turbine as recited in claim 10, wherein said rotating means comprises a shaft connected to said first collar and means for rotating said shaft.

12. The combustion turbine as recited in claim 8, wherein said first collar has a first seal means and said second collar has a second seal means, said first and second seal means cooperable to prevent leakage.

13. The combustion turbine as recited in claim 8, wherein said first collar has an expansion slot to minimize thermal stress.

14. A combustion turbine, comprising:

a compressor for producing compressed air;

a plurality of combustors in which a fuel is burned in a first portion of said compressed air to produce a hot gas;

a turbine, linked to said plurality of combustor, each said combustor linked to said turbine via an associated flow system;

each of said flow systems comprising a duct, a first collar having a plurality of encircling first ports connecting said duct to said combustor, and a second collar encircling said first collar having a plurality of encircling second ports in flow communication with said compressor, said second collar being rotatable between a first position wherein said plurality of second ports are placed in flow communication with said plurality of first ports and a second position wherein there is no flow communication between said plurality of second ports and said plurality of first ports for allowing a second portion of said compressed air to bypass said combustor and enter said flow system downstream of said combustor; and means for rotating said second collar of each of said flow systems;

where said second collar forms a manifold and has a third pore forming an inlet for said manifold and said first port forms an outlet for said manifold.

* * * * *